US005857621A

United States Patent [19]

Poulos

[11] Patent Number: 5,857,621

[45] Date of Patent: Jan. 12, 1999

[54] TISSUE PAPER SCENTING AND STORAGE APPARATUS

[76] Inventor: Jon D. Poulos, 23 Cambria Rd., Palm Beach Gardens, Fla. 33418

[21] Appl. No.: 864,715

[22] Filed: May 28, 1997

[51] Int. Cl.[6] ..... A24F 25/00

[52] U.S. Cl. ..... 239/52; 239/57; 239/60; 215/236; 220/331

[58] Field of Search ..... 239/34, 52, 57, 239/60, 289; 242/905; 206/5, 391, 394; 215/235, 236; 220/331, 329

[56] References Cited

U.S. PATENT DOCUMENTS

| | | | |
|---|---|---|---|
| D. 201,099 | 5/1965 | Brillante . | |
| D. 307,086 | 4/1990 | Van Marcke et al. . | |
| D. 314,301 | 2/1991 | Cooke . | |
| 2,440,974 | 5/1948 | Resch . | |
| 3,275,133 | 9/1966 | Wood | 206/394 |
| 3,316,040 | 4/1967 | McGann . | |
| 3,413,049 | 11/1968 | Smay . | |
| 3,930,696 | 1/1976 | Hight et al. | 312/39 |
| 4,177,958 | 12/1979 | Poole . | |
| 4,199,078 | 4/1980 | Ramirez | 221/309 |
| 5,624,025 | 4/1997 | Hixon | 206/233 |

*Primary Examiner*—Andres Kashnikow
*Assistant Examiner*—Lisa Ann Douglas
*Attorney, Agent, or Firm*—McHale & Slavin, P.A.

[57] ABSTRACT

A tissue paper storage and scenting apparatus having an interior chamber sized to accommodate from multiple rolls of tissue paper in a sealed environment ventilated through an upper portion of the apparatus which is receptive to fragrance producing materials. The tissue paper is maintained in a highly fragrant environment so as to provide a scent to the stored tissue rolls while preventing unwanted bathroom odors from spoiling the tissue paper. The instant invention further provides for scenting of the bathroom environment thereby forming a combination storage container and scenting mechanism that can be placed on a counter or along the floor providing ease of access to a bathroom guest.

6 Claims, 2 Drawing Sheets

10
12
14
16
18
20
21
22
23
23
24
26
28
30
32
32'
32"
34
35
36
38
50
52
54
56
58
60
62
63
63
64
66
68
70
72
74
76
78
80
82
84
85
85
86
88
90
92
94
96
97
98
99
102
104
106
108

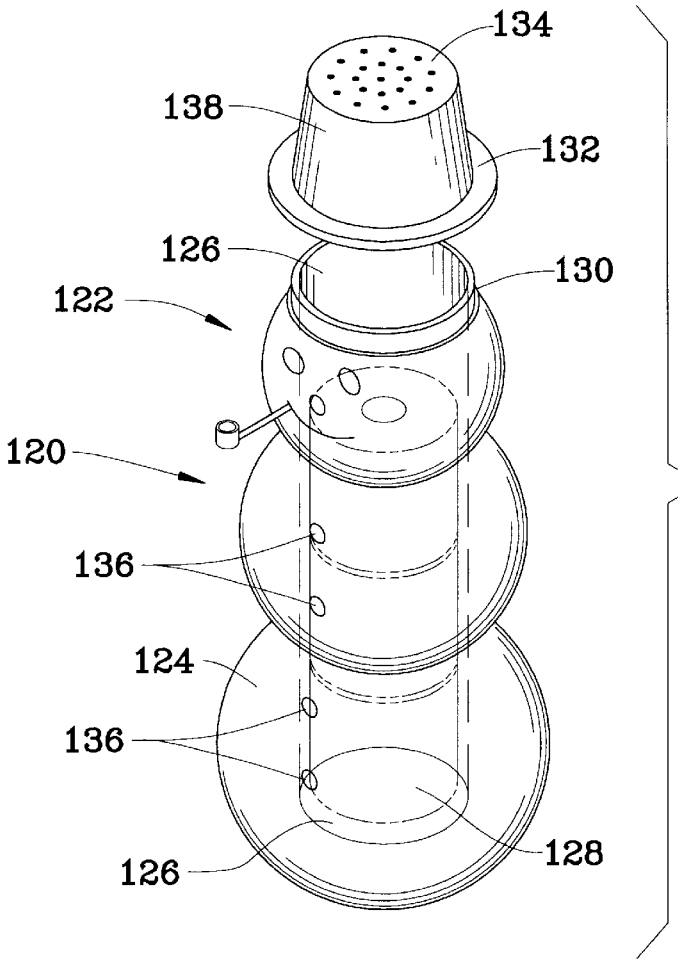
FIG. 4
FIG. 5
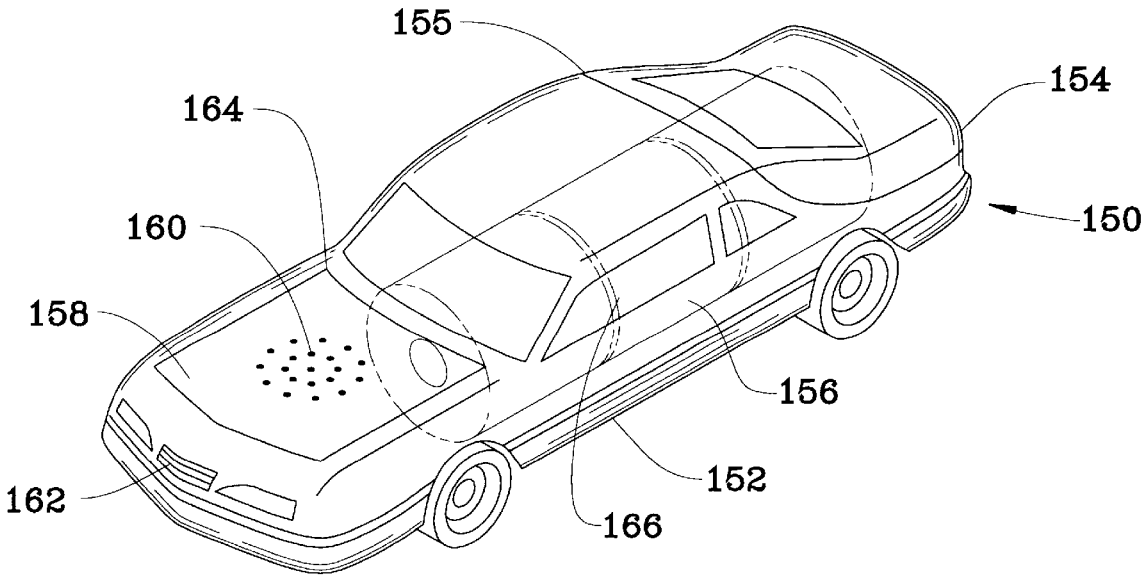

TISSUE PAPER SCENTING AND STORAGE APPARATUS

FIELD OF THE INVENTION

This invention is related to storage devices and in particular to a bathroom accessory for the storage and scenting of toilet paper tissue rolls.

BACKGROUND OF THE INVENTION

Tissue paper holders are common fixtures found in the home, business or commercial bathrooms. The tissue roll allows a consumer to simply remove tissue as necessary by unwinding the tissue roll as it is held on a spindle. Nearly all bathrooms have at least one tissue paper dispensing mechanism designed to hold a single roll of tissue paper. The problem that arises, to which this invention addresses, is when a replacement tissue roll is necessary. While a housekeeper or owner of the home may know where additional tissue rolls are stored, the situation does arise when a guest to the home is using the facilities when a tissue roll has expired. The guest may need to search closets and cabinets to find a replacement roll. Should the facilities be used frequently, it is quite possible that the last person may not notice the lack of tissue paper leading to a precarious if not embarrassing situation.

One method of addressing the problem is to dispose of a partially expired tissue roll before all the paper is used to prevent an inadequate supply. Alternatively, additional tissue rolls may be placed near the water closet or on a counter top. Placement of extra tissue rolls around the bathroom is unsightly and may lead to spoiling of the tissue paper due to its natural absorbing ability to pick up moisture and odors as later described.

To address these problems various teachings have been made in the prior art such as U.S. Pat. No. 3,316,040 which discloses a storage unit for tissue rolls having a cylindrical shaped body with a frontal door that can be raised to access rolls placed therein. A cover to the storage unit allows for insertion of tissue rolls to maintain supply.

U.S. Pat. No. 2,440,974 issued to Resch discloses a toilet paper humidifier housing that allows for the dispensing of tissue paper. The Resch device requires the use of a liquid to cause saturation of lining walls and does not teach the use of a storage device or scenting device wherein the dry scent material is placed above the stored tissue rolls.

U.S. Pat. No. 3,413,049 discloses a tissue roll holder having a locking mechanism for positioning rolls. The locking mechanism is inserted through the spindle wrapping aperture of the tissue roll.

U.S. Pat. No. 4,177,958 discloses a tissue roll holder and dispensing mechanism having a cylindrical tower to accommodate multiple tissue rolls. A support shelf allows the tower to further operate as a tissue dispenser.

Various design patents also disclose toilet paper tissue roll storage containers. Design U.S. Pat. Nos. 201,099; 307,086; 314,301; and 330,984 all set forth ornamental shapes for tissue roll holders and/or dispensers.

While the prior art addresses the need for storage of multiple tissue rolls, none of the prior art discloses the problems created with storing tissue paper after it is removed from its shipping package. The aforementioned storage devices require the tissue rolls to be removed from its packaged condition and placed into a storage device for subsequent use. While the availability of the tissue roll for subsequent use is a well documented benefit, a disadvantage is the absorbing qualities of the tissue paper having the ability to absorb unwanted foul bathroom odors. Should bathroom odors be absorbed, the odor can be released over a period of time as the tissue roll is dispensed.

Manufacturers of tissue roll paper acknowledge this situation by producing pre-scented tissue rolls. The fragrance is stronger than what would be commonly absorbed in a bathroom thus providing a nice scent to paper. However, once the tissue roll is unpacked the fragrance will begin to dissipate in the surrounding environment. Should the scented tissue rolls be stored in an unsealed container such as the aforementioned devices, the scent may completely dissipate before use. In addition, many of the pre-scented fragrances are objectionable to those consumers with a sensitive sense of smell.

Thus what is needed in the art is an apparatus having the ability to store multiple tissue paper rolls in an attractive container providing ease of accessibility and fresh scenting.

SUMMARY OF THE INVENTION

The present invention satisfies this need by the provision of a free standing storage container and scenting apparatus having the ability to house from two to four tissue rolls in a vertical stacked arrangement. The storage apparatus provides an enclosed interior chamber preventing the tissue rolls from absorbing unwanted odors. Along an upper portion of the storage apparatus is located a support shelf for placement of scenting materials. The support shelf is sized to allow air flow into an interior chamber housing providing the tissue rolls with a fragrance as chosen by the consumer.

The upper surface of the holder includes ventilation holes allowing the fragrance to expand into the bathroom area. Potpourri may be used as a scenting material with accessibility to renew the material with the addition of potpourri oil. Similarly, scent blocks can be placed on the support shelf eliminating the need for air fresheners that take up valuable counter space. Unique to this invention is the ability to make the tissue paper housings colorful by use of flowers and the like indicia along the sidewalls. Further, the housings can be concealed within various fictitious characters such as a snowman and/or replicas of objects such as automobiles.

Unlike spray air fresheners the instant apparatus maintains the fragrance by continually applying a fragrance scent to the stored tissue paper. Thus, when the tissue roll is utilized, the fragrance that was absorbed will provide a lingering scent in a similar fashion as store purchased scented tissue rolls.

Therefore, an objective of the instant invention is to provide improvements in storage containers for toilet paper tissue rolls, while maintaining the need to provide a storage housing which is easily accessed.

Still another objective of this invention is to provide a low cost enclosed tissue roll storage container for preventing the spoilage of unpackaged tissue rolls and further providing a means for scenting of tissue rolls according to the preference of the consumer.

Yet still another objective of the instant invention is to provide a concealed area for maintaining of various scenting materials including disposable air freshening solids or renewable air freshening materials such as potpourri.

Still another objective of the instant invention is to conceal tissue paper within fictitious characters such as a snowman or replicas of automobiles and the like.

Other objectives and advantages of the instant invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

BRIEF DESCRIPTION OF THE DRAWINGS

FIG. 4 is a perspective view of the instant invention concealed within a snowman; and FIG. 5 is a perspective view of the instant invention concealed within a replica of an automobile.

DETAILED DESCRIPTION OF THE PREFERRED EMBODIMENT

Figures 1, 2, 3:
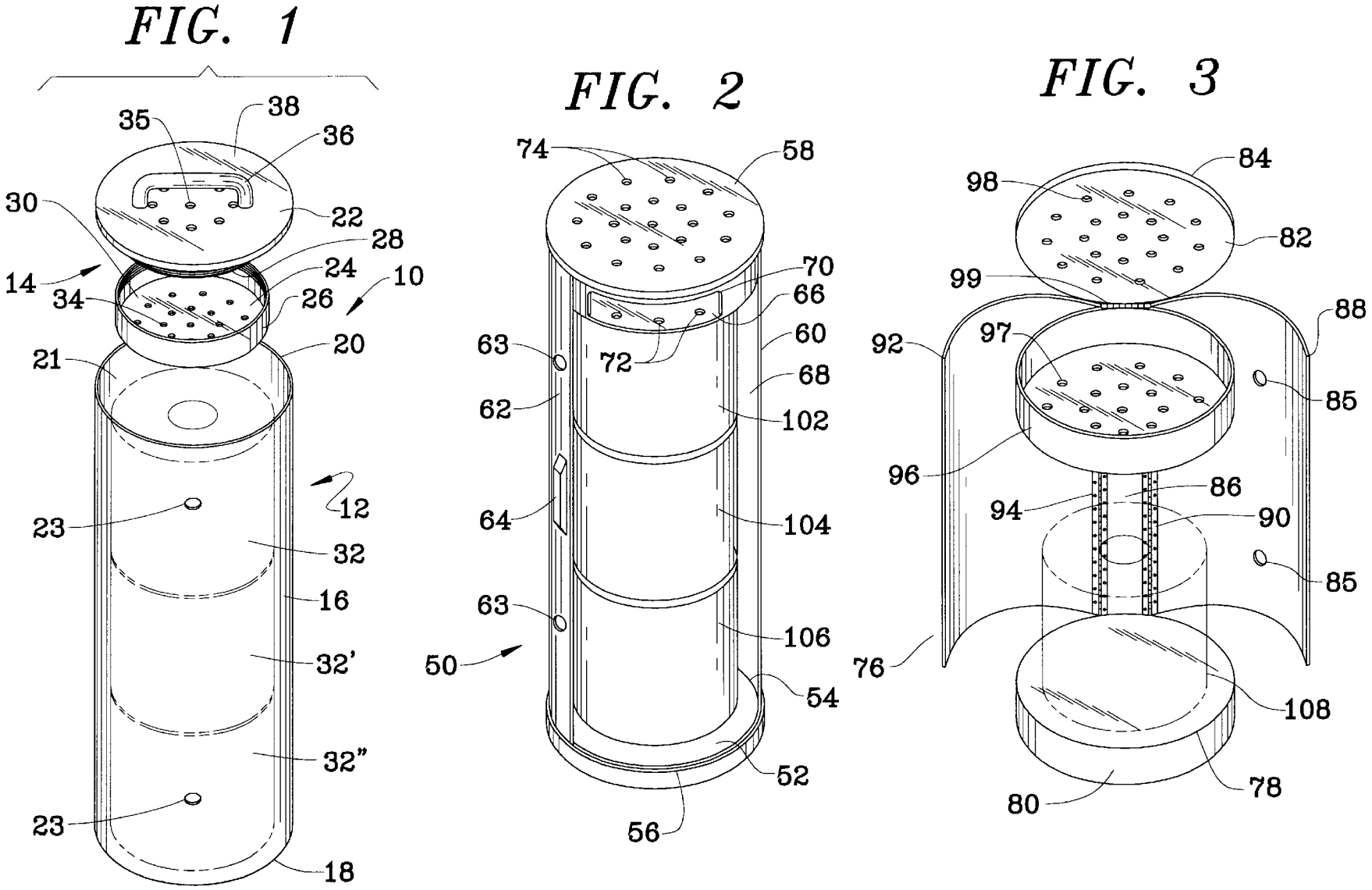
FIG. 1 is a perspective view of a first embodiment of the instant invention depicting a cylindrical shaped tissue roll housing that has a removable scenting material canister and is sized to accommodate three tissue rolls.
FIG. 2 is a perspective view of a second embodiment of the instant invention depicting a cylindrical shaped tissue roll housing having a rotatable access door and sized to accommodate three tissue rolls.
FIG. 3 is a perspective view of a third embodiment of the instant invention depicting cylindrical shaped tissue roll housing having double doors for accessing of a chamber sized to accommodate two tissue rolls.

Now referring to FIG. 1, a first embodiment of the instant invention is shown. The toilet paper tissue roll scenting and storage apparatus 10 includes a tissue paper housing 12 and a scenting material canister 14. The housing 12 is essentially a cylindrical shell 16, one end of which is bounded by a circular bottom wall 18. The housing 12 has an open end 20 which is sized to receive the scenting material canister 14. The housing creates an interior chamber 21 that is sized to accept 3 stacked rolls of tissue paper 32, $32^1$, $32^{11}$. simultaneously. The shell 16 includes inspection apertures 23 to allow monitoring of the contents of the housing 12.

The scenting material canister 14 is defined by a circular top plate 22 and a circular bottom plate 24 which are spaced apart by a continuous sidewall 26 that extends orthogonally between them. The sidewall 26 and bottom plate are permanently jointed, while the top plate 22 may be removed. An attachment ring 28 extends downward from the top plate 22. The attachment ring 28 includes threads (not shown) sized to engage threads (not shown) included along the top of the canister sidewall 26. The top plate 22 may be unscrewed from the sidewall 26 to reveal an interior compartment 30 within the canister 14. With the top plate 22 removed, scenting materials (not shown) are placed into the exposed interior compartment 30, supported by the bottom plate 24. The bottom plate 24 is perforated by through holes 34 which allow osmotic transfer of scent from the scenting materials located in the canister 14 to the tissue paper 32, $32^1$, $32^{11}$ stored in the housing 12, below. Top plate 22 has through holes 35 which similarly allow scent transfer into the room containing the apparatus 10.

The top plate 22, bottom plate 24, and sidewall 26 are sized so that the canister 14 may be easily inserted into the open end 20 of the tissue paper housing 12. Specifically, the outer diameter of the top plate 22 is substantially the same as the outer diameter of the cylindrical shell 16, and the outer diameter of the bottom plate 24 is substantially equal to the inner diameter of the cylindrical shell 16. With these dimensions, the canister will remain suspended at the top of the housing 12, even if the housing is partially empty. A handle 36 extends from the upper surface 38 of the top plate 22, to ease manipulation of the canister 14.

Now referring to FIG. 2, shown is a second embodiment of the instant invention setting forth a tissue paper scenting and holder apparatus 50 defined by a bottom wall 52 having a circular shaped perimeter edge 54 with a door track 56 formed along at least a portion of the perimeter edge 54. The bottom wall 52 is spaced apart from a top wall 58 a fixed distance by sidewall 60 in order to accommodate multiple tissue rolls 102, 104 and 106. The top wall 58 is formed into a circular shape having an upper perimeter edge and door track so as to form a mirror image of said bottom wall. Side wall 60 is permanently secured to the bottom wall 52 and top wall 58 forming a partial cylindrical tower. A one piece door 62 having a vertical side wall operatively associated with the upper and lower door track forming an interior chamber for the tissue rolls by sliding said door 62 along the door track. Handle 64 is available to assist in sliding of said door 62. The bottom wall 52 may be weighted so as to prevent accidental tippage should a person inadvertently try to open the door 62 without supporting the base securely. Inspection apertures 63 provide interior viewing.

Support shelf 66 having a surface area equal to or less than bottom wall 52 is positioned along upper portion of inner surface 68 of the side wall 60. The support shelf 66 includes opening 70 allowing access to the shelf for placement of scenting materials. As noted, a plurality of through holes 72 are provided for scenting of the tissue paper placed within the housing while the door 62 is in a closed position. The door 62 further seals the opening 72 for scenting the interior chamber. A plurality of through holes 74 is further provided along the top wall 58 allowing a controlled release of the fragrance into the bathroom area. The storage device is sized to house from two to four tissue rolls in a vertical stacked arrangement.

Now referring to FIG. 3 shown is a third embodiment of a tissue paper scenting and storage apparatus 76 having a base housing defined by a bottom wall 78 with a circular shaped perimeter edge 80 spaced apart from a top wall 82 having a circular shaped perimeter edge 84 coupled together by side wall 86 sized to accommodate multiple tissue rolls. Side wall 86 forms a partial cylinder tower with a first rotatable cover 88 hingedly attached to the sidewall 86 by hinge member 90. Similarly, second cover 92 is hingedly attached to side wall 86 by hinge member 94. Inspection apertures 85 provide interior viewing.

Support shelf 96 is available for placement of scenting material such as potpourri having a plurality of through holes 97 available for scenting of tissue paper placed within the interior chamber when double doors 88 and 92 are placed into a closed position. Top wall 82 includes a plurality of through holes 98 allowing the fragrance dispersion into the bathroom area when the cover 84 is placed upon the support shelf 96. Unlike potpourri, open containers or conventional scenting sticks, the limited access openings 98 inhibit a total release of the fragrance thus forcing the scenting of the interior chamber and stored tissue rolls through openings 97. Cover 84 may be simply placed upon the support shelf or coupled by hinge member 99 allowing the cover 84 to be rotated upward for access to the support shelf 96 and placement of associated scenting material. It should be noted in this embodiment the bottom wall 78 may be weighted. Hinge members 90 and 94 may also be conventional hinge members, longitudinal piano hinge type members, or plastic fold lines depending upon the materials of construction. A forth embodiment, not shown, assimilates the third embodiment by use of a single door member in place of the double door wherein the side wall is simply enlarged allowing the use of a single door for access into the interior chamber.

Now referring to FIG. 4 shown is an embodiment of the instant invention placed within a fictitious snowman character 120. The snowman housing includes a head 122 securable to body portion 124 encompassing an interior chamber 126 for placement of tissue rolls 128 therein. The chamber may assimilate the storage housing shown in FIGS. 2 or 3. Alternatively, a hat portion 132 is removable from the head 122 at break line 130 to conceal an opening accessing interior chamber 126. As set forth in previous embodiments, the scenting material is positional above the interior chamber with ventilation holes 134 for scenting the immediate area. The hat 138 includes a support shelf, not shown, for placement of the scenting material. Buttons 136, conceal inspection ports used to determine the amount of tissue rolls placed within the chamber 126.

FIG. 5 is yet another example of housing tissue rolls within a unique housing. Depicted is a replica of an automobile 150, based upon the first embodiment having a body 152 supporting multiple tissue rolls 156 in an interior chamber. The trunk 154 of the device may be pivoted at hinge point 155 allowing access to the chamber for removal of stored tissue rolls. In this embodiment a scenting shelf is placed within the engine compartment located beneath hood cover 158. Ventilation holes 160 are provided along the top of the hood or through the grill 162 allowing scenting of the immediate area. Access to the scenting materials is possible by rotating the hood cover 158 along hinge line 164 in a manner similar to a conventional automobile engine load. Window openings 166 provide the inspection apertures for determining the amount of tissue paper stored within the interior chamber.

It is to be understood that while I have illustrated and described certain forms of my invention, it is not to be limited to the specific forms or arrangement of parts herein described and shown. It will be readily apparent to those skilled in this art that various changes may be made without departing from the scope of the invention and the invention is not to be considered limited to what is shown in the drawings and described in the specification.

What is claimed is:

1. A tissue paper scenting and holder apparatus comprising: a base housing defined by a bottom wall having a circular shaped perimeter edge with a door track formed along at least a portion of said perimeter edge spaced apart from a top wall having a circular shaped upper perimeter edge and a door track formed along at least a portion of said upper perimeter edge forming a mirror image of said bottom wall and coupled together by a sidewall having a height and forming a partial cylindrical tower; a one piece cover having a vertical sidewall slidably positioned and operatively associated with said upper and lower door track; means for scenting an interior chamber formed by said base housing and said cover when placed in a closed position; wherein said base and cover form a cylindrical tower shaped structure having an interior chamber sized to accommodate at least one conventional roll of tissue paper whereby a scenting material is positioned above the paper for scenting.

2. The tissue paper scenting and holder apparatus according to claim 1 wherein said height is sized to accommodate up to four tissue paper rolls stacked in a vertical position.

3. The tissue paper scenting and holder apparatus according to claim 1 wherein said cover includes an elongated vertical slot allowing visual inspection of the tissue rolls within said apparatus.

4. The tissue paper scenting and holder apparatus according to claim 1 wherein said means for scenting is further defined as a support shelf having a surface area less than said bottom wall and disposed along an inner surface of said sidewall above the tissue rolls for support of scent releasing materials.

5. The tissue paper scenting and holder apparatus according to claim 1 wherein said cover includes a plurality of through holes to allow a controlled release of scent releasing materials to the bathroom environment.

6. The tissue paper scenting and holder apparatus according to claim 1 wherein an outer surface of said cover is available for placement of floral indicia.

* * * * *